US006390433B1

(12) United States Patent
Kasa-Djukic

(10) Patent No.: US 6,390,433 B1
(45) **Date of Patent: *May 21, 2002**

(54) EASEL, ESPECIALLY FOR CANVAS FRAMES (STRETCHERS), FOR USE IN PAINTING

(76) Inventor: Vladimir Kasa-Djukic, Werneckstr. 31, 80802 Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/584,097

(22) PCT Filed: May 21, 1992

(86) PCT No.: PCT/DE92/00423

§ 371 Date: Nov. 8, 1993

§ 102(e) Date: Nov. 8, 1993

(87) PCT Pub. No.: WO92/20261

PCT Pub. Date: Nov. 26, 1992

Related U.S. Application Data

(63) Continuation of application No. 08/146,057, filed on Nov. 8, 1993, now abandoned.

(30) Foreign Application Priority Data

May 22, 1991 (DE) ..... 41 16 710
May 21, 1992 (DE) ..... PCT/DE92/00423

(51) Int. Cl.[7] ..... A47F 5/10; A47B 97/04

(52) U.S. Cl. ..... 248/441.1; 248/458; 248/125.1; 248/125.2

(58) Field of Search ..... 248/441.1, 124.1, 248/125.1, 404, 676, 178.1, 183.1, 296.1, 449, 454, 460, 651, 662, 669, 447, 448, 457, 458, 125.2, 123.11

(56) References Cited

U.S. PATENT DOCUMENTS

| | | | | | |
|---|---|---|---|---|---|
| 976,759 | A | * | 11/1910 | Weingaertner | 248/125 X |
| 1,606,369 | A | * | 11/1926 | Johnston | 248/457 |
| 1,611,497 | A | * | 12/1926 | Tharp | 248/454 |
| 2,309,578 | A | * | 1/1943 | Drachman | 248/125 |
| 2,434,827 | A | * | 1/1948 | Akers | 248/662 X |
| 2,599,269 | A | * | 6/1952 | Markle | 248/404 X |
| 3,006,107 | A | | 10/1961 | Tolegian | |
| 3,231,230 | A | * | 1/1966 | Mueller | 248/449 |
| 3,926,398 | A | | 12/1975 | Vincent | |
| 4,577,827 | A | * | 3/1986 | Eliscu | 248/662 X |
| 4,836,494 | A | * | 6/1989 | Johnsen | 248/201 |

FOREIGN PATENT DOCUMENTS

| | | | | |
|---|---|---|---|---|
| CH | 207313 | * | 1/1940 | 248/449 |
| DE | 0 924 477 | | 3/1955 | |
| FR | 690601 | * | 9/1930 | 248/454 |

* cited by examiner

*Primary Examiner*—Leslie A. Braun
*Assistant Examiner*—Jonathon Szumny
(74) *Attorney, Agent, or Firm*—Connolly Bove Lodge & Hutz LLP

(57) ABSTRACT

An electromotively controllable easel is disclosed for canvas frames (stretchers) which find application, especially, in painting. The canvas frames (stretchers) are vertically movable. The canvas frame (stretcher) can also be rotated about the center axis.

14 Claims, 8 Drawing Sheets

Figure 1:
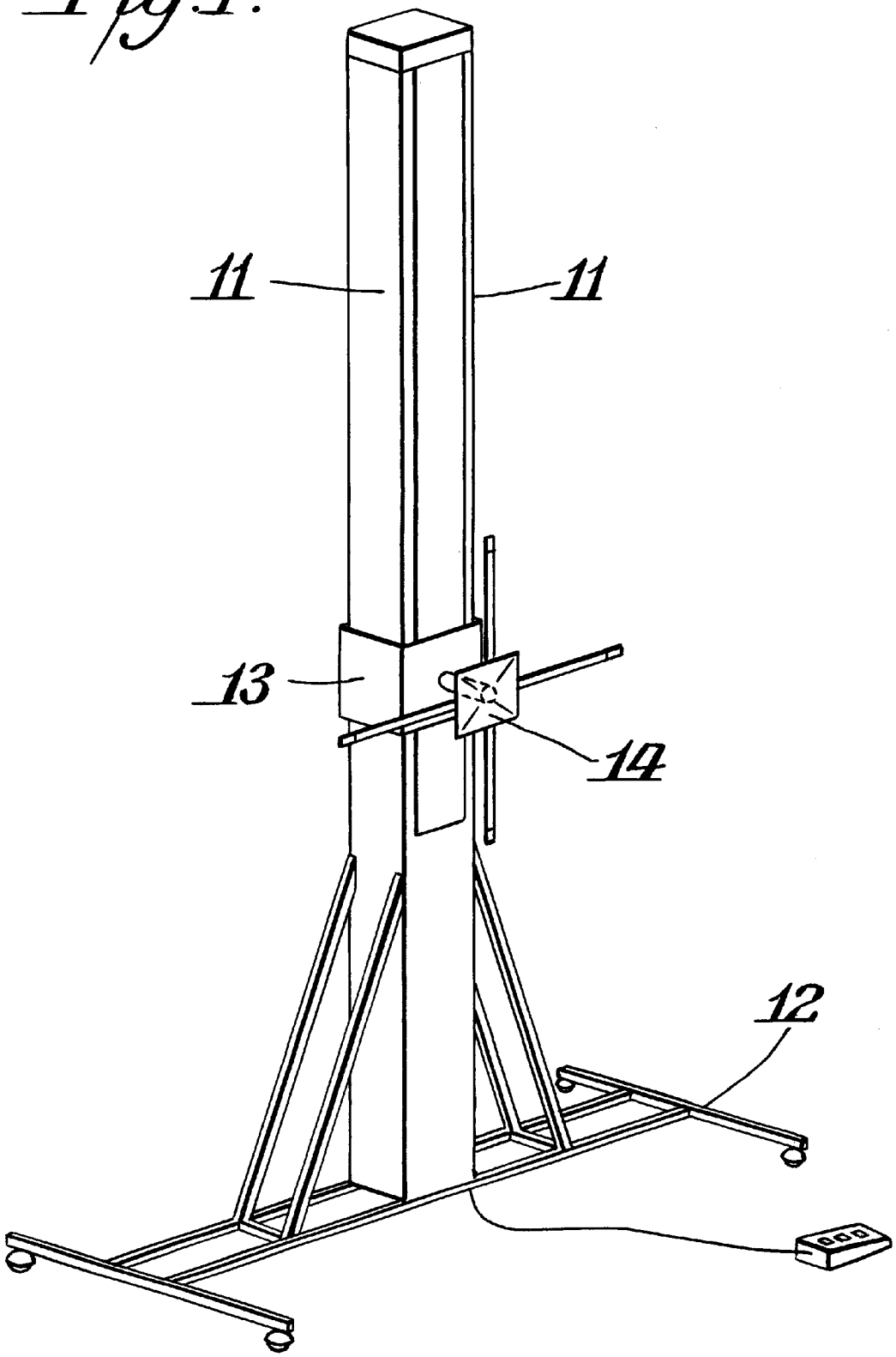

61
63
63A
64
65
65A
66
62
67

EASEL, ESPECIALLY FOR CANVAS FRAMES (STRETCHERS), FOR USE IN PAINTING

This application is a continuation, of application Ser. No. 08/146,057 filed on Nov. 8, 1993, now abandoned.

In the field of art, especially of painting, artists frequently work on large-sized grounds. These are conventionally in the form of canvas which is tension-mounted on stretchers. Occasionally, other ground materials such as wood or cardboard blocks and the like are also used.

These painting grounds have to be held by specific devices as they are being worked. Conventionally, the painting grounds are therefore fixed on an easel whilst the artist is working. Easels of this kind are known, in which the painting grounds are fixed tightly. The connection is generally effected by the canvas, which is drawn onto a stretcher, being clamped in place. Whenever, therefore, a canvas frame (stretcher) is fastened to the easel, a static, immovable connection exists between the canvas frame (stretcher) and the easel.

The object of the present invention is to provide further easels which enable the artists to work better.

Professional painters normally work in a certain style. An essential component part of this style is also the manner in which the brush or the painting tool is guided. Most artists have a particular direction and a particular uniqueness in terms of their stroking. This particular style, which is dependent upon the line composition, is conventionally practiced by the artists in a specific posture which can vary from artist to artist. The easel described below according to the invention enables the artist to work in an optimal manner, since that place on the canvas which is to be worked can be adapted to the posture of the artist which is optimal for working.

An essential component part of the easel according to the invention is the support element. This support element can be fitted approximately at a right-angle to a preferably mobile stand. A static fastening of the support element in certain rooms, such as, for example, in studios, would also be conceivable. The stand bearing the support element can be provided with rollers to enable the easel to be displaced without difficulty. The wheels or rollers of the stand can preferably be at least partially secured.

In a preferred embodiment, the support element is formed by a column. This column can be formed, for example, by two sectional rails disposed parallel to each other. Recesses on the edges of the sectional rails can serve as rails for the holding element, which can be moved in these rails by means of rollers or wheels. An essential feature is that the one, central column is designed such that the interior is hollow and at least one, or better still, two sides remain free, so that the holding element fitted on the support element is also able to extend into the interior of the support column. One embodiment of the easel, according to the invention, having a central column, is represented by way of example in FIG. 1.

In another embodiment, the support element exhibits two support columns which are disposed parallel to each other and to which the holding element is fitted. An embodiment of this type is represented, for example, in FIG. 2.

In a further embodiment, the easel according to the invention exhibits three support columns. An embodiment of this type is represented diagrammatically in plan view in FIG. 3.

For certain embodiments, especially where particularly large or heavy objects are to be held by the easel, the support element can also exhibit four or more columns.

Figure 4:
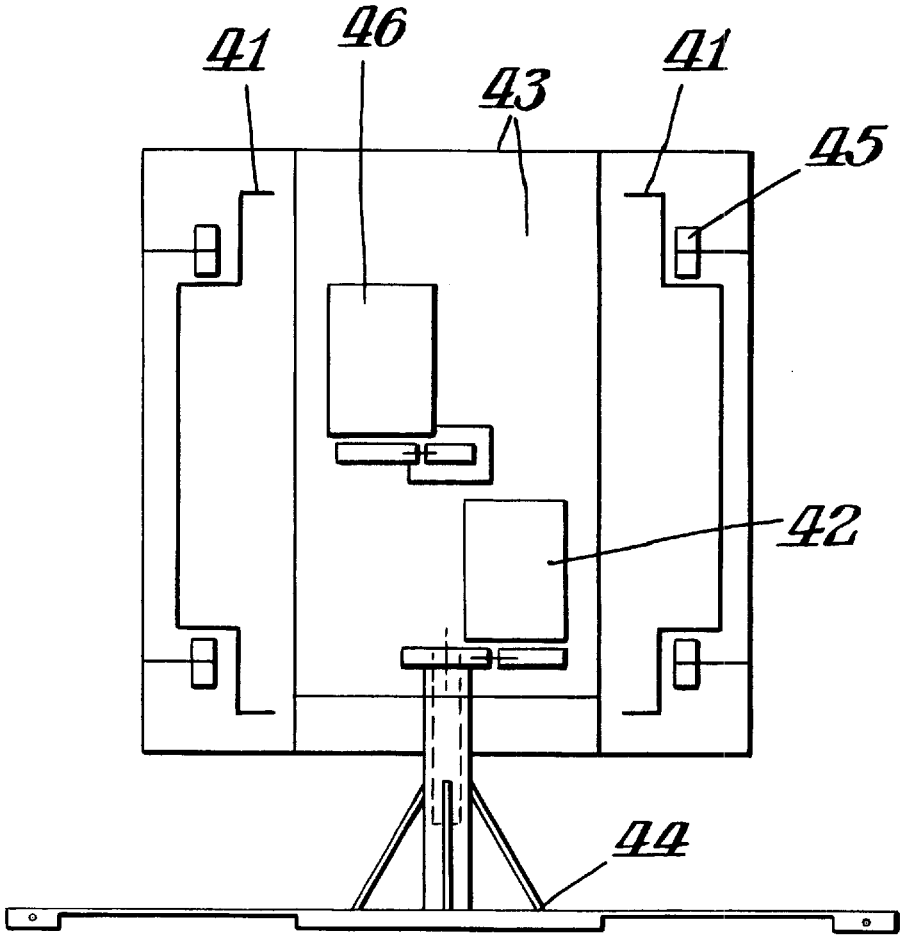

Movably fitted to the support element is a holding element which, together with a fastening device, forms the connection to the object to be held. What is preferably meant by a movably fitted holding element is that the holding element can be moved over a large part of the support element. Depending upon the constructional design of the easel according to the invention, various forms of the holding element are usable. In the embodiment shown in FIG. 1, the holding element constitutes a box which encloses the support column and projects into the interspace between the two sectional rails. FIG. 4 shows diagrammatically the arrangement of the holding element in relation to the support element formed by the sectional rail. In this embodiment, the box-shaped holding element exhibits eight wheels or rollers, which are disposed such that they fit into the recesses in the sectional rails and produce a precise-fitting, movable connection. That part of the box-shaped holding element which projects into the interspace between the two sectional rails supports in a preferred manner the drive means, preferably an electric motor, for the vertical movement, as well as the drive means, preferably an electric motor, for the rotational movement which can be exerted upon the fastening device.

In another preferred embodiment of the present invention, the holding element constitutes a plate which exhibits recesses for the support elements. An embodiment of this type is represented, for example, in FIG. 3. The plate with recesses can move in the vertical direction on the supports. To improve stability, sleeves can be fitted to the recesses of the holding element parallel to the support columns, which sleeves enable the plate to be stabilized against tilts. Here too, there are provided on the holding plate both devices for the movement in the vertical direction and means for the rotational movement of the fastening device.

On the easel various objects can be fastened which are worked by artists. Conventionally, a painting ground is fastened on the easel. The ground in question can take the form of cardboard or wooden blocks, though conventionally, as painting ground, canvas is used, which is normally tension-mounted on stretchers. These stretchers comprise a rectangular lath framework to which the outer margins of the canvas to be worked are fastened. The canvas frames (stretchers) also often exhibit a cross-like reinforcement structure, in which the midpoints of the opposing frame parts are respectively joined together.

In a preferred embodiment of the present invention, the fastening device is rotatable, the axis of the fastening device being disposed at an angle of 45°–90°, preferably around 90°, to the axis of the support element. The respective angle can be adjustable by virtue of suitable constructional embodiments. The connection between the support column and the frame (stretcher) is created by means of the holding element and the fastening device.

In a preferred embodiment of the present invention, the holding element and the fastening device for the canvas frame (stretcher) are designed to be separable from each other.

The fastening device is fastened to the canvas frame (stretcher). Preferably, the fastening is here effected in such a way that the fastening device is connected to the canvas frame (stretcher) by means of clamping members and/or screw connections.

In an especially preferred embodiment of the present invention, the fastening device is fastened to the cross in the canvas frame (stretcher).

In a preferred embodiment, the holding element exhibits a receiving member, which is disposed rotatably about an axis at an angle of around 90° to the axis of the support element. The receiving member in question can be a bushing, which is designed such that rotation by an electric motor and, where appropriate, a gear system is made possible.

Into this receiving member there can be introduced the insertion member located on the fastening device. In one embodiment, the insertion member in question is a spigot which fits precisely into the bushing.

The connection between the holding element and the fastening device is preferably designed such that twisting of the insertion member in relation to the receiving member is impossible. This can be achieved, for example, by the receiving member exhibiting recesses and by the insertion member exhibiting elevations which fit precisely into the recesses in the receiving member. The connection further exhibits, in a preferred manner, a latchable locking device, which prevents the fastening device from becoming inadvertently detached from the holding element.

In a preferred embodiment, the fastening device exhibits a plate which is disposed at a right-angle to the insertion member. This, for example, right-angled plate can exhibit four recesses which are disposed along the connecting lines joining the respectively opposing corners. Through these recesses can be guided clamping members, for example screw clamps or screwable hooks, which bring about a connection between the fastening device and the cross of the frame (stretcher). To increase stability, the fastening device can further exhibit extensions, which can be designed to be extensible and which form further supporting points on the frame (stretcher) or on the cross of the frame (stretcher).

The separable connection between the fastening device and the holding element has the advantage that the often very large canvas frames (stretchers) can be fastened without difficulty to the easel. Furthermore, the canvas frame (stretcher) can be easily exchanged with the aid of the separable connection between the holding element and the fastening device.

The easels according to the invention exhibit drive devices which enable the holding element to move in the vertical direction, parallel to the axis of the support element. As drive mechanisms, various solutions are conceivable here. As a preferred solution according to the invention, the easel exhibits a toothed rack which is disposed parallel to the support columns. This toothed rack exhibits notches in which a gearwheel, which is fastened to the holding element, engages. This gearwheel is driven, either directly or by means of a gear system, by an electric motor, which can run forwards or backwards. By the rotation of the gearwheel, the holding element then moves upwards or downwards, depending upon the direction of running of the electric motor.

In another embodiment, the easel exhibits a threaded spindle which is disposed parallel to the support columns. This spindle is guided through a sleeve having a counter-thread matching the thread of the spindle. This sleeve is firmly connected to the holding element. A rotation of the spindle now gives rise, depending upon the direction of rotation, to an upward or downward movement of the holding element. This spindle can be driven either directly by an electric motor or by means of a gear system of an electric motor.

In a further embodiment, the drive can be effected by a cable which is guided through appropriately disposed rollers such that, when the cable is wound onto a roller or unwound, the holding device can be moved upwards or downwards.

In a very particularly preferred embodiment, the holding element is moved up and down by means of a toothed belt, the toothed belt being guided over two toothed rollers, one of which, preferably the lower, is able to be driven by means of an electric motor.

The drive devices are driven, in a preferred manner, by electric motors, but other types of drive are also possible. Another type of drive would be, for example, a manual operation which is effected by the rotation of one or more cranks.

A transmission of the rotational movement from the electric motor to the element to be moved, especially to the spigot shaft for the plug-on part of the fastening device, is preferably effected by mutually engaging gearwheels.

The present invention is explained in greater detail, by way of example, with reference to the attached figures:

FIG. 1 shows an easel according to the invention, in which the support element comprises a column. The column is formed by two sectional mouldings (11) disposed opposite each other, the support column standing on a rollable stand (12) which lends the easel the necessary stability against tilting. Fastened to the column is a holding element (13), which can be moved up and down along the support element. Connected to the holding element (13) is the fastening device (14). The canvas frame (stretcher) is fitted to the fastening device.

Figure 2:
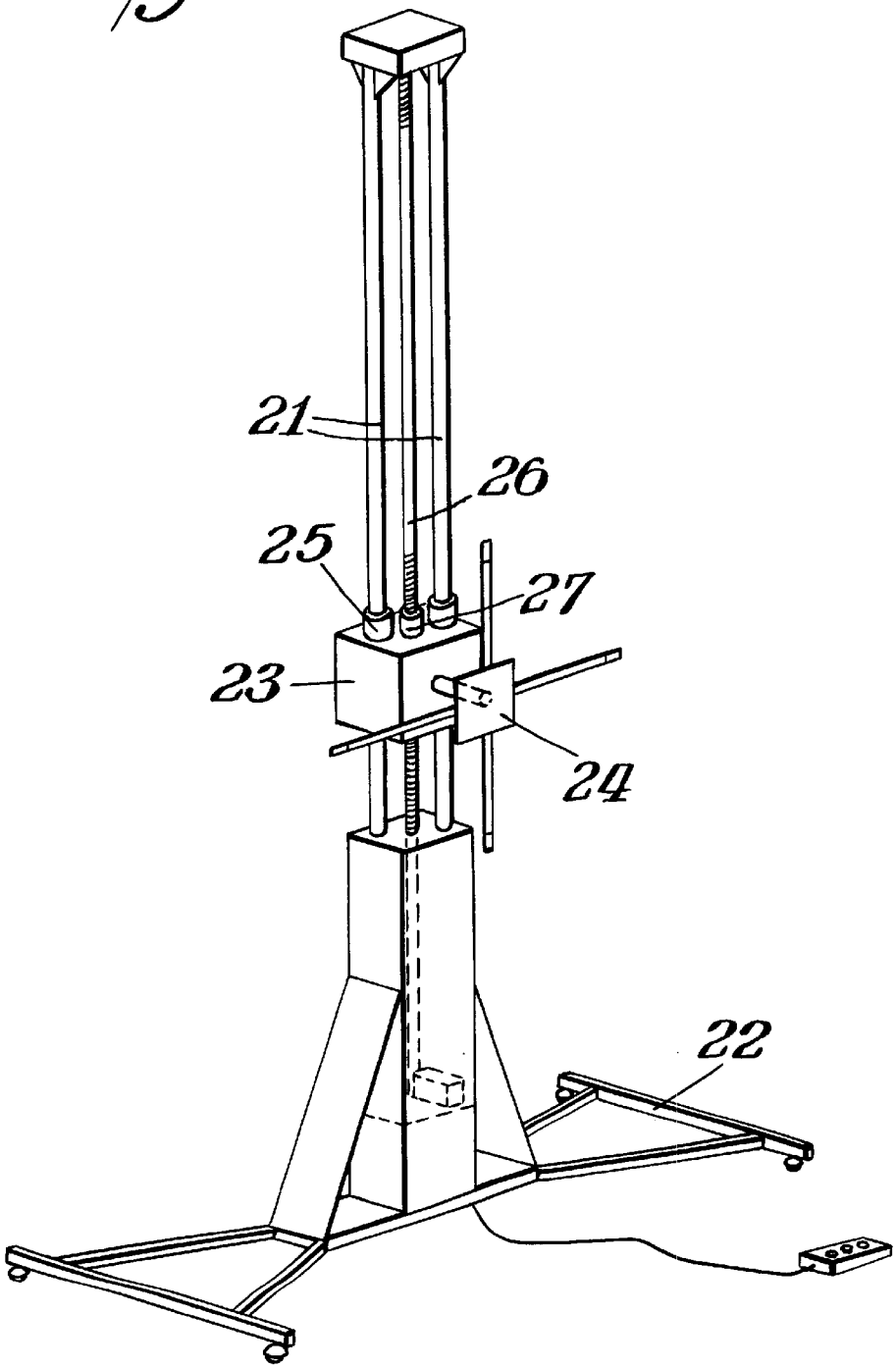

FIG. 2 shows another embodiment of the easel according to the invention, which easel exhibits two support columns (21) disposed parallel to each other. The support column is located on a stand (22), which lends the easel the necessary stability against toppling over.

The holding device (23) is able to move along the support columns (21). At the place of the support columns, the holding element exhibits bushings (25), which allow a better guidance of the holding element. Connected to the holding element (23) is the fastening device (24), which serves to fasten the canvas frame (stretcher). Parallel to the support columns (21) there is disposed a spindle (26) which extends through the support element. This spindle exhibits a thread, the counter-thread thereto being located within the sleeve (27) which is fastened to the holding element.

Figure 3:
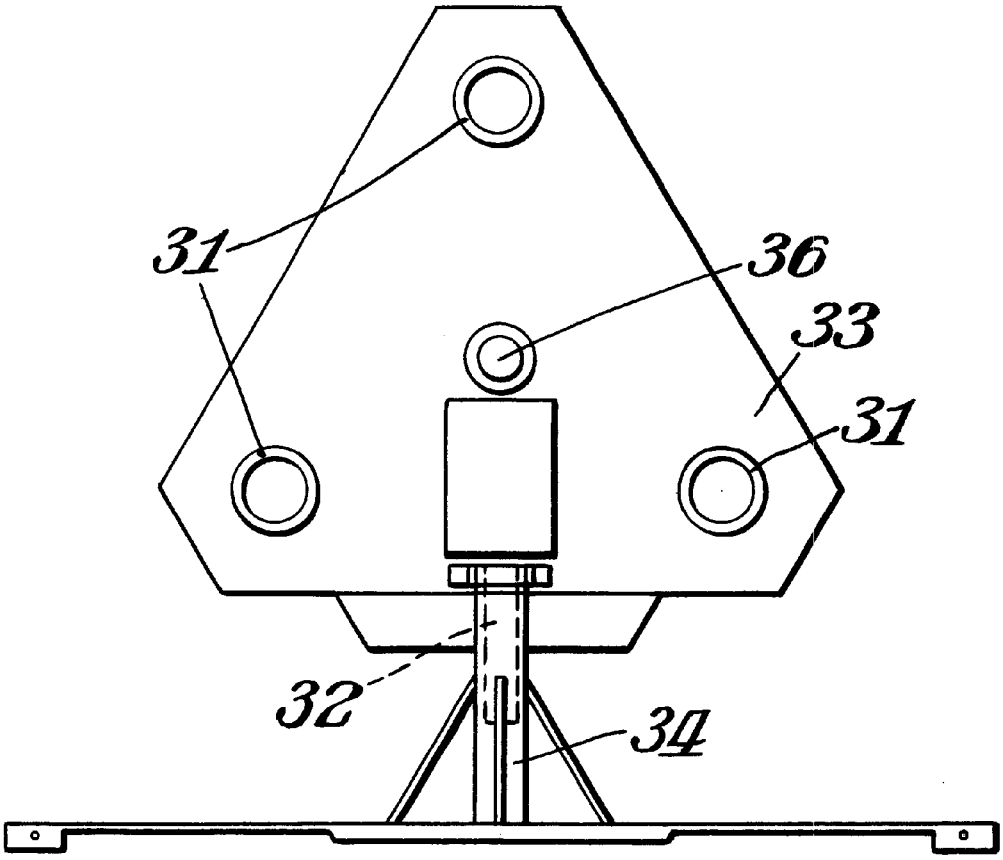

FIG. 3 shows a further embodiment of the easel according to the invention, in plan view. The approximately triangular holding element (33) is able to move along the support columns (31). The drive is realized by the drive means (36), here represented diagrammatically. The holding element further exhibits the receiving member (32), here represented diagrammatically, into which the insertion member of the fastening device (34) can be introduced.

FIG. 4 shows diagrammatically a cross-section through an embodiment of the easel according to the invention, as shown in FIG. 1. The support column is in this case formed by the sectional mouldings (41). These sectional mouldings are surrounded by a box-shaped holding element (43), which also extends between the two sectional mouldings (41). The box-shaped holding element is guided, by rollers or wheels (45) fitted thereto, into the rail-like grooves formed by the sectional mouldings. The upward and downward movement is realized by the drive means, which are represented diagrammatically (46). The fastening device (44) can be rotated by a rotating device (42) about an axis disposed at an angle of 90° to the support column.

Figure 5:
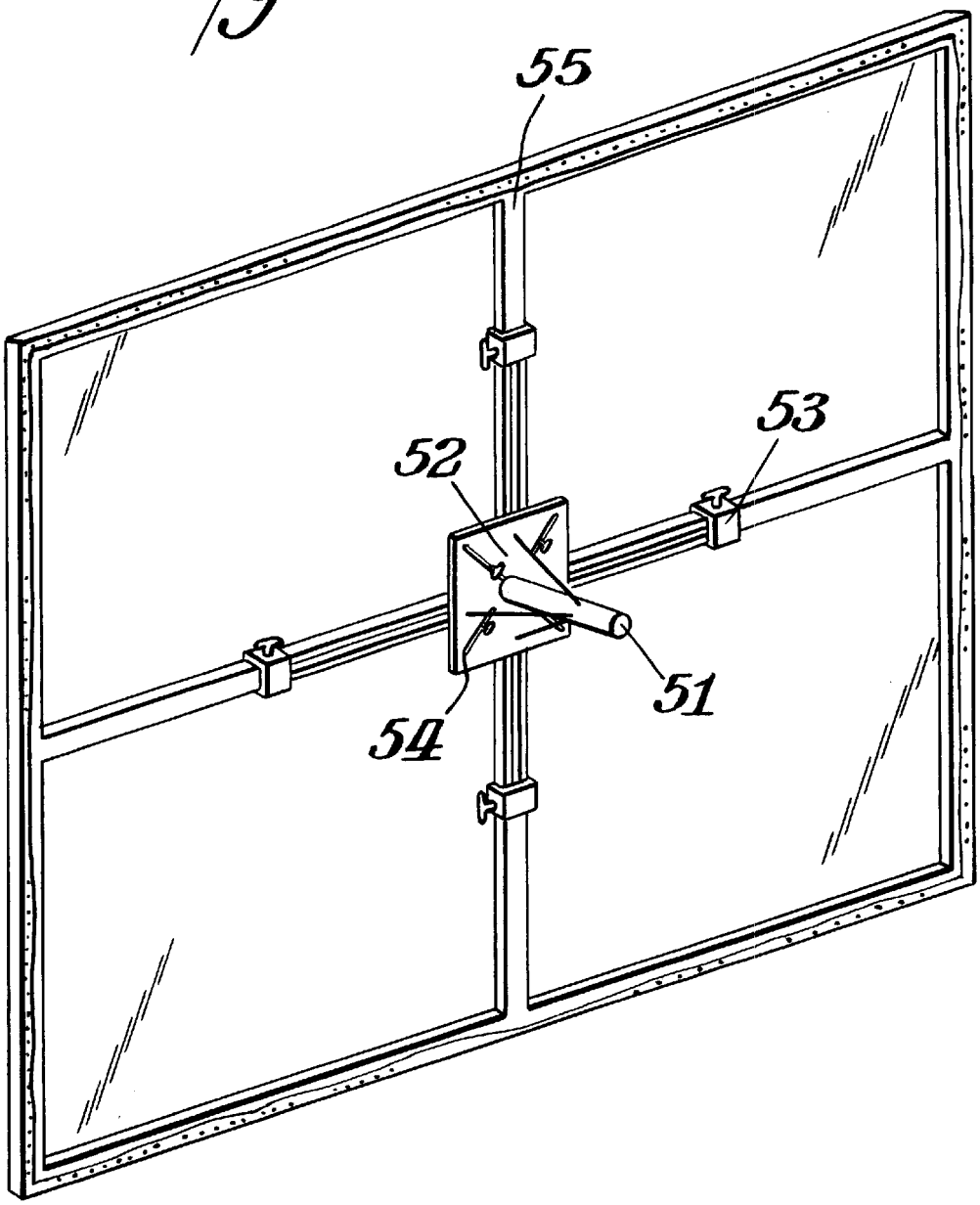

FIG. 5 shows a fastening device which is fastened to a canvas frame (stretcher) (55). The, fastening device exhibits an insertion spigot shaft (51) which is fastened to a plate (52). Fitted to the plate are extensions (53), which allow fastening to the cross of the frame (stretcher). In the plate there are further provided elongated recesses (54), through which clamping members or screwable hooks can be guided, which allow a further connection of the fastening device to the cross frame.

Figure 6:
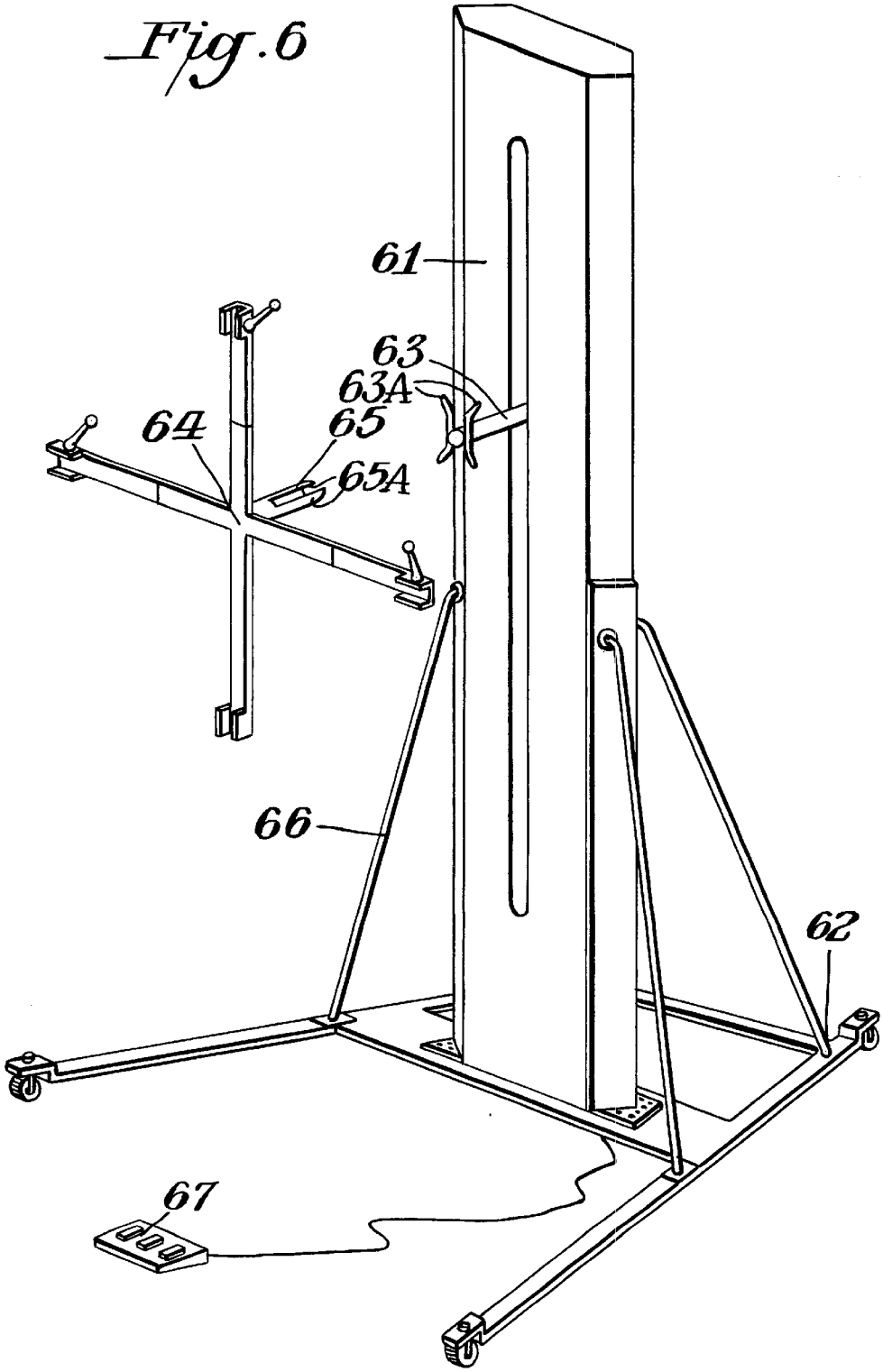

FIG. 6 shows an especially preferred embodiment of the easel according to the invention. The support element exhibits in cross-section, for example, a flattened hexagon. The two support columns (61) are joined together at the upper and lower ends. Over the greater part of the height however, there is cleared between the two support columns, on the front side, an elongated slot, from which there protrudes a spigot shaft of the holding device (63), which holding device can be moved upwards and downwards in this slot. In the embodiment shown here, a cylindrical spigot shaft (63) of the holding device can seen, the spigot exhibiting, on two sides, elevations which are disposed such that the mounting element (65) of the fastening device (64) can be slipped onto the spigot shaft of the holding device (63). The elevations belonging to the spigot shaft (63) of the holding device are designed such that they interact with the recesses in the mounting element (65) in such a way that any twisting of the mounting element (65) in relation to the spigot (63) of the holding device is precluded. with the spigot shaft (63) without use of fasteners, such as screws or nuts and bolts, so that when the mounting element is engaged with the spigot, shaft the fastening device will not substantially twist relative to the spigot, and so that when the painting ground is fastened by the fastening device, the painting ground is held substantially perpendicular to the axis of rotation of the spigot.

The support column is connected to the stand (62) by additional side props (66), which increase the mechanical stability of the construction. The control unit (67) is also represented diagrammatically, by means of which the movement of the holding device and of the fastening device connected thereto can be controlled.

Figure 7:
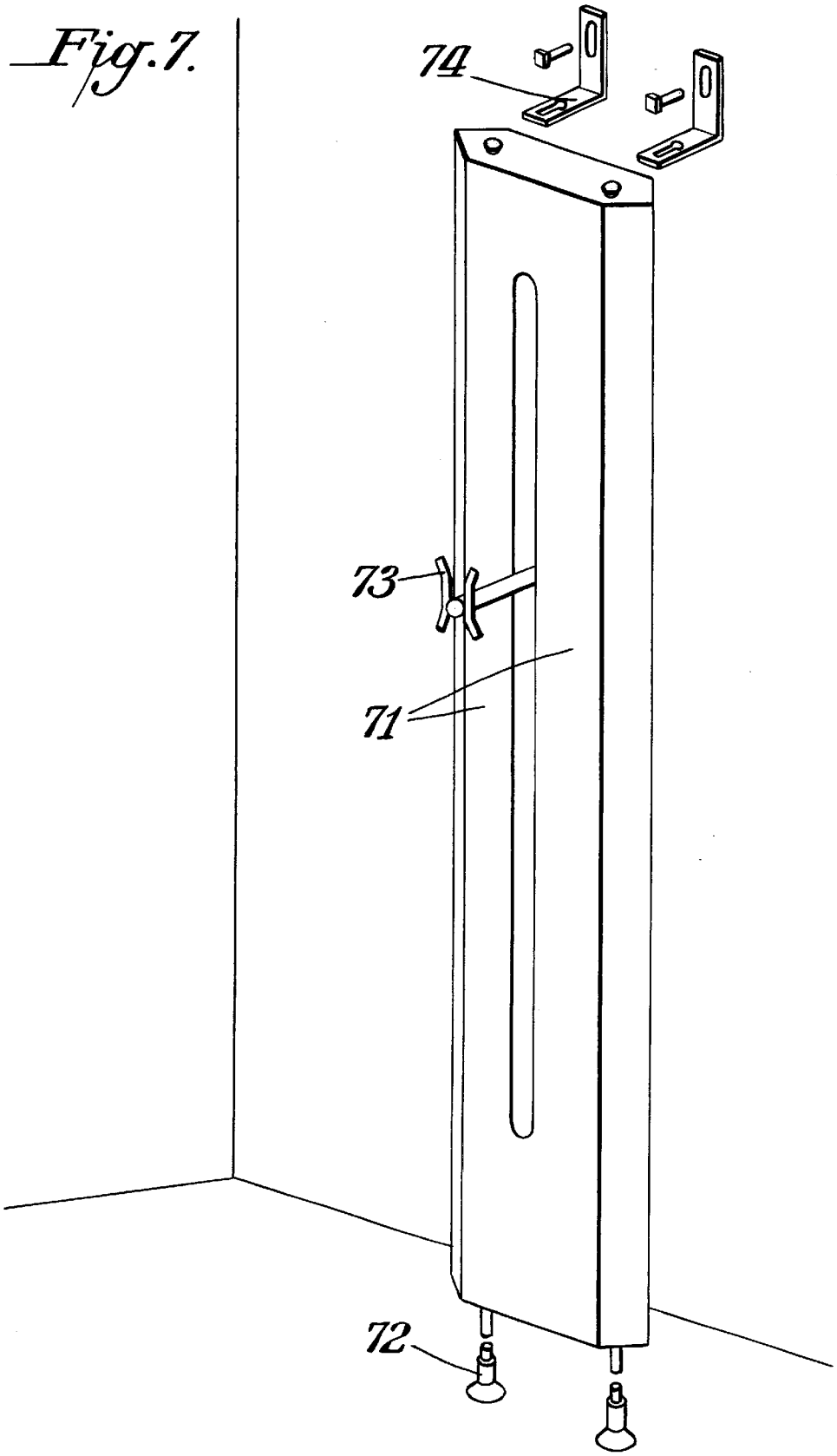

FIG. 7 shows a preferred embodiment of the easel according to the invention, which can be fastened immovably to a wall. The support element corresponds essentially to the support element shown in FIG. 6; it exhibits the support columns (71), leaving free between them an elongated slot in which the spigot (73) of the holding device is able to move. The support element rests upon level-adjustable feet (72), by which any bumps in the ground can be evened out. At its upper end, the support element is fastened to the wall at the fastening angles (74). This embodiment is especially preferred where a spatial mobility of the easel is not necessary and where it is important to save space. This can be the case, for example, in respect of art academies, where several artists or students work together within a relatively tight space.

Figure 8:
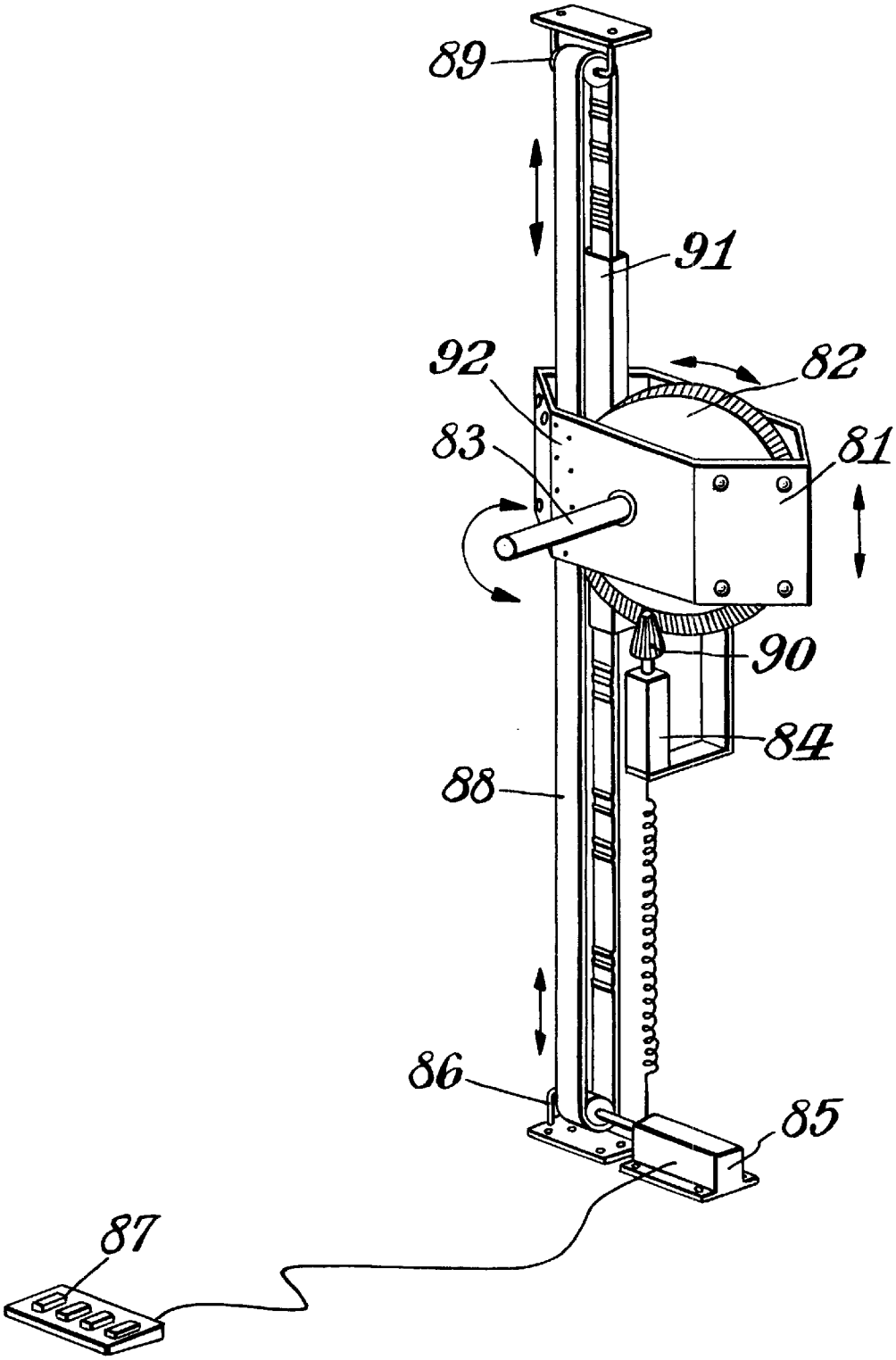

FIG. 8 shows diagrammatically an especially preferred embodiment of the mechanics, which allows a vertical movement of the holding element and a movement of the spigot (83) of the holding element about an axis disposed at an angle of around 90° to the axis of the support element. The holding element exhibits a guide rail (81), which is movable in the support element (not shown here) and allows a precise guidance of the holding element. On the guide rail (81) there is rotatably connected the spigot (83) and a toothed disc (82) connected thereto. The spigot (83) and the toothed disc (82) connected thereto can be rotated about an axis disposed at an angle of around 90° to the axis of the support element. The rotatability in both directions is realized by means of an electric motor (84), which is connected by a conical toothed piston (90) to the toothed disc (82). The toothed disc (82) exhibits, in the represented, preferred embodiment, conically running teeth, in which the teeth of the conical toothed piston (90) engage. Depending upon the direction of running of the electric motor, the toothed disc (82) moves in the one or other direction. The entire holding element can be moved with the aid of the electric motor (85). The electric motor (85) is connected to a toothed roller (86). Around the lower toothed roller (86) and the upper toothed roller (89) there runs a toothed belt (88), which is fastened by its two ends to the fastening region (92) of the holding element. The toothed belt (88) further exhibits, on the part lying opposite the fastening region (92), a counterweight (91). By rotation of the lower toothed roller (86), the holding element can be moved upward or downward.

The easel according to the invention allows the artists working with it an exact presentation of the different parts of the ground to be worked and, to be more precise, in the place best corresponding to the posture of the artist. Due to the mechanical adjustability, the canvas can be brought to the desired positions. The rotatability of the canvas frame (stretcher) about its own axis enables the artist to work in a way which, without the easel according to the invention, could not be readily attained.

What is claimed is:

1. An easel for a stretched canvas or other painting ground, comprising:

a support element defining a substantially vertical axis;

a holding element fitted onto the support element and moveable with relation to the support element along the axis of the support element;

electrically operable means for moving the holding element along the axis of the support element;

a spigot having a distal end and a proximal end, said spigot shaft projecting from the holding element and rotatable through 360° rotation about an axis disposed at an angle of between about 45° and about 90° to the axis of the support element;

a fastening device for fastening the painting ground, said fastening device having a mounting element formed of a plurality of arcuate portions axially removably engageable and cooperative with a means for preventing rotation on the shaft so that when the mounting element is engaged with the spigot shaft, the fastening device will not substantially twist relative to the spigot shaft, and so that when the painting ground is fastened by the fastening device, the painting ground is held substantially perpendicular to the axis of rotation of the spigot shaft; and means for rotating said spigot that includes an electric motor.

2. The easel of claim 1, wherein the proximal end of the spigot shaft is engaged with the holding element and the rotation prevention means includes elevations that extend from the distal end of the spigot shaft, and the elevations of the spigot shaft interact with recesses provided in the mounting element of the fastening device when the fastening device is engaged with the spigot shaft.

3. The easel of claim 1, wherein the fastening means further comprise a plate disposed substantially perpendicular to the mounting element, and at least two clamping members for holding the painting ground fastened to the plate.

4. The easel of claim 1, wherein the proximal end of the spigot shaft is connected to a toothed disc within the holding element, and the holding element further comprises a toothed, piston engageable with the toothed disc, and an electric motor to drive the piston so that the spigot shaft will rotate about an axis disposed at an angle in the range of about 45° to 90° to the axis of the support element.

5. The easel of claim 1, wherein the electrically operable means for moving the holding element comprises a toothed rack disposed essentially parallel to the support element, a gearwheel fitted to the holding element and engageable with the toothed rack, and an electric motor to drive the gearwheel.

6. The easel of claim 1, wherein the electrically operable means for moving the holding element comprises a rotatable threaded spindle disposed essentially parallel to the support element, a counter-threaded sleeve fastened to the holding element and engageable with the threaded spindle and an electric motor to rotate the threaded spindle.

7. The easel of claim 1, wherein the electrically operable means for moving the holding element comprises a toothed belt engageable with a toothed roller driven by an electric motor.

8. The easel of claim 1 in combination with a stretched canvas or other painting ground.

9. The easel of claim 1, further comprising a rollable stand.

10. The easel of claim 1, further comprising fastening angles to attach the support element to a solid substantially vertical surface.

11. The easel of claim 10, wherein the fastening angles are provided to attach the support element to a wall.

12. An easel for a stretched canvas or other painting ground, comprising:

a support element defining a substantially vertical axis;

a holding element fitted onto the support element and movable with relation to the support element along the axis of the support element;

means for fastening the painting ground attached to the holding element, said fastening means being rotatable about an axis disposed at an angle of between about 45° and about 90° to the axis of the support element, so that when the painting ground is fastened by the fastening means, the painting ground is held substantially perpendicular to the axis of rotation of the fastening means;

means for rotating said fastening means that includes an electric motor; and a toothed belt fastened to the holding element and a toothed roller acting upon said toothed belt to adjust the vertical position of the holding element along the axis of the support element, wherein a counterweight is applied to the toothed belt along its length and at a position distant from that at which the holding element is fastened.

13. The easel of claim 12, wherein the toothed roller is driven by an electric motor.

14. The easel of claim 12, wherein the holding element comprises a guide rail movable within the interior of the support element.

* * * * *

UNITED STATES PATENT AND TRADEMARK OFFICE

CERTIFICATE OF CORRECTION

PATENT NO. : 6,390,433 B1
DATED : May 21, 2002
INVENTOR(S) : Vladimir Kasa-Djukic It is certified that error appears in the above-identified patent and that said Letters Patent is hereby corrected as shown below:

Column 6,
Lines 30 and 47, “spigot” should read -- shaft --.
Lines 31, 41, 42, 46, 50, 52, 53, 55, 62 and 65, “spigot” should be deleted.
Line 47, "spigot" should read -- shaft --.
Line 64, the comma after “toothed” should be deleted.

Signed and Sealed this

Twenty-sixth Day of August, 2003

JAMES E. ROGAN
*Director of the United States Patent and Trademark Office*